US007182416B1

(12) United States Patent
Greiner

(10) Patent No.: US 7,182,416 B1
(45) Date of Patent: Feb. 27, 2007

(54) JEWELRY ORGANIZER

(76) Inventor: Lori Greiner, 1301 Dearborn Pkwy., Suite 402, Chicago, IL (US) 60610

( * ) Notice: Subject to any disclaimer, the term of this patent is extended or adjusted under 35 U.S.C. 154(b) by 370 days.

(21) Appl. No.: 10/656,536

(22) Filed: Sep. 5, 2003

(51) Int. Cl.
*A47B 96/16* (2006.01)

(52) U.S. Cl. ..... 312/321.5; 312/309; 206/6.1

(58) Field of Classification Search ..... 312/294, 312/227, 308, 309, 310, 321.5, 300, 120, 312/123, 245; 206/6.1
See application file for complete search history.

(56) References Cited

U.S. PATENT DOCUMENTS

| | | | | |
|---|---|---|---|---|
| 1,131,713 | A | 3/1915 | Kramer | |
| 1,133,866 | A * | 3/1915 | Leighty | 312/240 |
| 1,369,577 | A | 2/1921 | Miller | |
| 1,600,830 | A | 9/1926 | Lewis | |
| 1,975,779 | A * | 10/1934 | Church | 312/31 |
| 2,268,637 | A | 1/1942 | Bernstein | |
| 2,286,427 | A | 6/1942 | Levensten | |
| 2,513,150 | A | 6/1950 | Davis | |
| 2,582,812 | A * | 1/1952 | Wise | 312/242 |
| 2,663,608 | A | 12/1953 | Schauer | |
| 2,739,697 | A | 3/1956 | Kuddes | |
| 2,995,409 | A | 8/1961 | Simonsen | |
| 3,078,133 | A | 2/1963 | Schauer | |
| 3,591,244 | A | 7/1971 | Hancock, Jr. | |
| 3,639,022 | A | 2/1972 | Elmo | |
| 3,813,138 | A | 5/1974 | Doohan | |
| 3,876,271 | A | 4/1975 | Skirlock | |
| 3,930,702 | A | 1/1976 | Pichowicz | |
| 4,120,549 | A | 10/1978 | Bureau | |
| 4,239,308 | A | 12/1980 | Bradley | |
| 4,324,446 | A * | 4/1982 | LeSage | 312/245 |
| 4,371,077 | A | 2/1983 | Solitt et al. | |
| 4,396,121 | A | 8/1983 | Lemmon | |
| 4,511,041 | A | 4/1985 | Waitzman | |
| 4,616,891 | A | 10/1986 | Jantzen | |
| D289,351 | S | 4/1987 | Jenkins | |
| 4,717,024 | A | 1/1988 | Djezovic | |
| 4,771,206 | A | 9/1988 | Taylor | |
| 4,811,996 | A | 3/1989 | Hansson | |
| 4,850,658 | A | 7/1989 | Sandor | |
| 4,854,656 | A | 8/1989 | O'Keefe | |
| 4,874,119 | A * | 10/1989 | Winter | 224/610 |
| 4,936,463 | A | 6/1990 | Tiramani | |
| 4,984,854 | A | 1/1991 | DeLavallade | |
| 4,989,291 | A * | 2/1991 | Parent | 15/315 |
| 5,102,209 | A | 4/1992 | Hesseltine | |
| 5,108,162 | A | 4/1992 | Lund | |
| 5,117,971 | A | 6/1992 | Fisher | |
| 5,261,529 | A | 11/1993 | Holland | |
| 5,358,100 | A | 10/1994 | Wolff | |
| 5,378,005 | A * | 1/1995 | Norton | 280/47.26 |

(Continued)

FOREIGN PATENT DOCUMENTS

DE 19924969 A1 12/2000

(Continued)

*Primary Examiner*—James O. Hansen
(74) *Attorney, Agent, or Firm*—Fredrikson & Byron, P.A.

(57) ABSTRACT

A jewelry organizer for storing a plurality of types of jewelry. The organizer may have pivoting cabinets in which earring, necklace and bracelet stands may be located. Additionally, accessory poles may also be provided. The organizer is versatile because it is configurable to a user's needs.

32 Claims, 14 Drawing Sheets

U.S. PATENT DOCUMENTS

| | | | | |
|---|---|---|---|---|
| D358,708 | S * | 5/1995 | Ko | D3/276 |
| 5,411,139 | A | 5/1995 | Victory | |
| D361,430 | S | 8/1995 | Mohundro | |
| 5,484,092 | A | 1/1996 | Cheney | |
| 5,511,873 | A | 4/1996 | Mech | |
| 5,558,418 | A | 9/1996 | Lambright et al. | |
| 5,685,624 | A | 11/1997 | Lee | |
| 5,690,401 | A | 11/1997 | Franklin | |
| 5,692,605 | A | 12/1997 | Lai | |
| 5,762,184 | A | 6/1998 | Greiner | |
| 5,941,255 | A | 8/1999 | Chen | |
| 6,045,202 | A | 4/2000 | Simon | |
| 6,595,609 | B1 | 7/2003 | Greiner | |
| 6,857,519 | B2 * | 2/2005 | Daetweiler et al. | 206/6.1 |
| 2002/0117945 | A1 | 8/2002 | Norman et al. | |

FOREIGN PATENT DOCUMENTS

| | | |
|---|---|---|
| FR | 940 540 | 12/1948 |
| GB | 287249 | 3/1928 |
| GB | 2205225 A | 12/1988 |
| GB | 2 217 298 A | 10/1989 |
| GB | 2 273 649 A | 6/1994 |
| GB | 2345630 A | 7/2000 |
| JP | 2000-197530 | 7/2000 |
| WO | 99/00005 | 1/1999 |

* cited by examiner

JEWELRY ORGANIZER

FIELD OF THE INVENTION

The present invention relates to a jewelry organizer with unique features for storing a plurality of types of jewelry articles. In particular, the preferred embodiments of the invention relate to organizers that allow a user to store a large quantity of jewelry articles and easily view and select from those jewelry articles.

BACKGROUND OF THE INVENTION

There are many types of jewelry organizers known. One type of a known jewelry organizer is in the form of a container with relatively high sides and back walls and a top that is hinged to the back wall to permit access into the container. Earring stands are fixed to the bottom of the container. A particular disadvantage with this type of jewelry organizer is that it is very difficult to insert and remove jewelry items from the stands because the side walls and hinged top limit the amount of space available.

Yet another type of jewelry organizer proposes racks that slide into a box-like container having a single open side. Again, a disadvantage with this type of jewelry organizer is that because the racks are designed as an integral part of the box-like container, when the racks are removed from the container, the racks cannot be placed on a horizontal surface without falling over. In addition, because there is only one open side, access to the jewelry located inside the container is limited.

It is desirable to provide a jewelry organizer that allows various jewelry articles to be neatly arranged, easily viewed and simply retrieved. In addition, it is desirable to provide a jewelry organizer that holds a large quantity of jewelry articles.

SUMMARY OF THE INVENTION

According to a first aspect of the invention, there is provided an organizer including a framework having a base and a back wall extending perpendicularly from the base; a pair of symmetrically arranged doors pivotally coupled to the base wherein each door has a first wall and a second wall perpendicular to the first wall, wherein the doors can be pivoted from a first closed position to a second open position, wherein in the closed position, the first walls are substantially parallel with the back wall and each second wall extends between the back wall and a respective first wall so that the organizer has a box shape and wherein in the second open position, the second walls are substantially parallel with the back wall; and a pole extending from an interior side of a first wall of at least one of the doors.

According to a second aspect of the invention, there is provided an organizer including a housing having a compartment defined by a base, a back wall extending perpendicularly from the base and side walls extending perpendicularly from the base and back wall and at least one door coupled to the base wherein when the door is closed it extends between the side walls; a groove formed on an interior surface of the base of the housing; and a groove formed in the back wall of the housing.

According to a third aspect of the invention, there is provided an organizer for jewelry, the organizer including a framework having a base and a back wall extending perpendicularly from the base; a door pivotally coupled to the base wherein the door has a first wall and a second wall perpendicular to the first wall, wherein the door can be pivoted from a first closed position to a second open position, wherein in the closed position, the first wall is substantially parallel with the back wall and the second wall extends between the back wall and the first wall and wherein in the second open position, the second wall is substantially parallel with the back wall; a groove formed in the door; and a separate first stand having a base which is dimensioned to be slidably received in the groove, the stand having a T configuration on which necklaces an bracelets may be hung.

According to a fourth aspect of the invention, there is provided an organizer including a framework having a base and a back wall extending from the base; a pair of symmetrically arranged doors pivotally coupled to the base, wherein the doors can be pivoted from a first closed position to a second open position; and a pole extending from an interior side of at least one of the doors.

According to a fifth aspect of the invention, there is provided an organizer including a housing having at least one door; a groove formed on an interior surface of a base of the housing; and a groove formed in a back wall of the housing.

According to a sixth aspect of the invention, there is provided an organizer for jewelry, the organizer including a framework having a base and a back wall extending from the base; a door pivotally coupled to the base wherein, the door can be pivoted from a first closed position to a second open position, a groove formed in the door; and a separate first stand having a base which is dimensioned to be slidably received in the groove, the stand having a T configuration on which necklaces an bracelets may be hung.

DETAILED DESCRIPTION OF THE PREFERRED EMBODIMENTS OF THE PRESENT INVENTION

Figure 1:
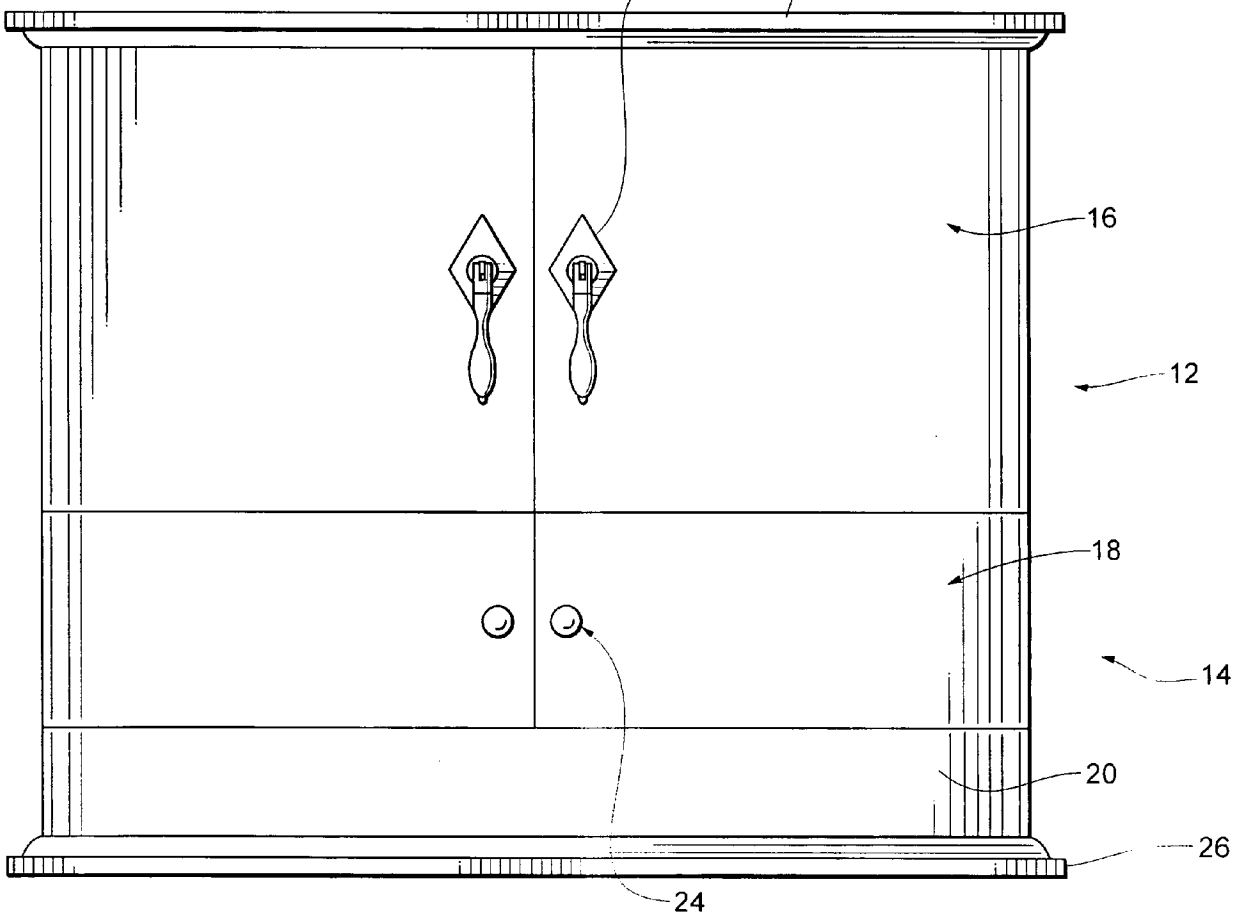
FIG. 1 is a front elevational view of an organizer according to a preferred embodiment of the present invention.

The following detailed description should be read with reference to the drawings. The drawings depict selected preferred embodiments and are not intended to limit the scope of the invention. It will be understood that preferred embodiments shown in the drawings and described below are merely for illustrative purposes, and are not intended to limit the scope of the invention as defined in the claims that follow.

Figure 13:
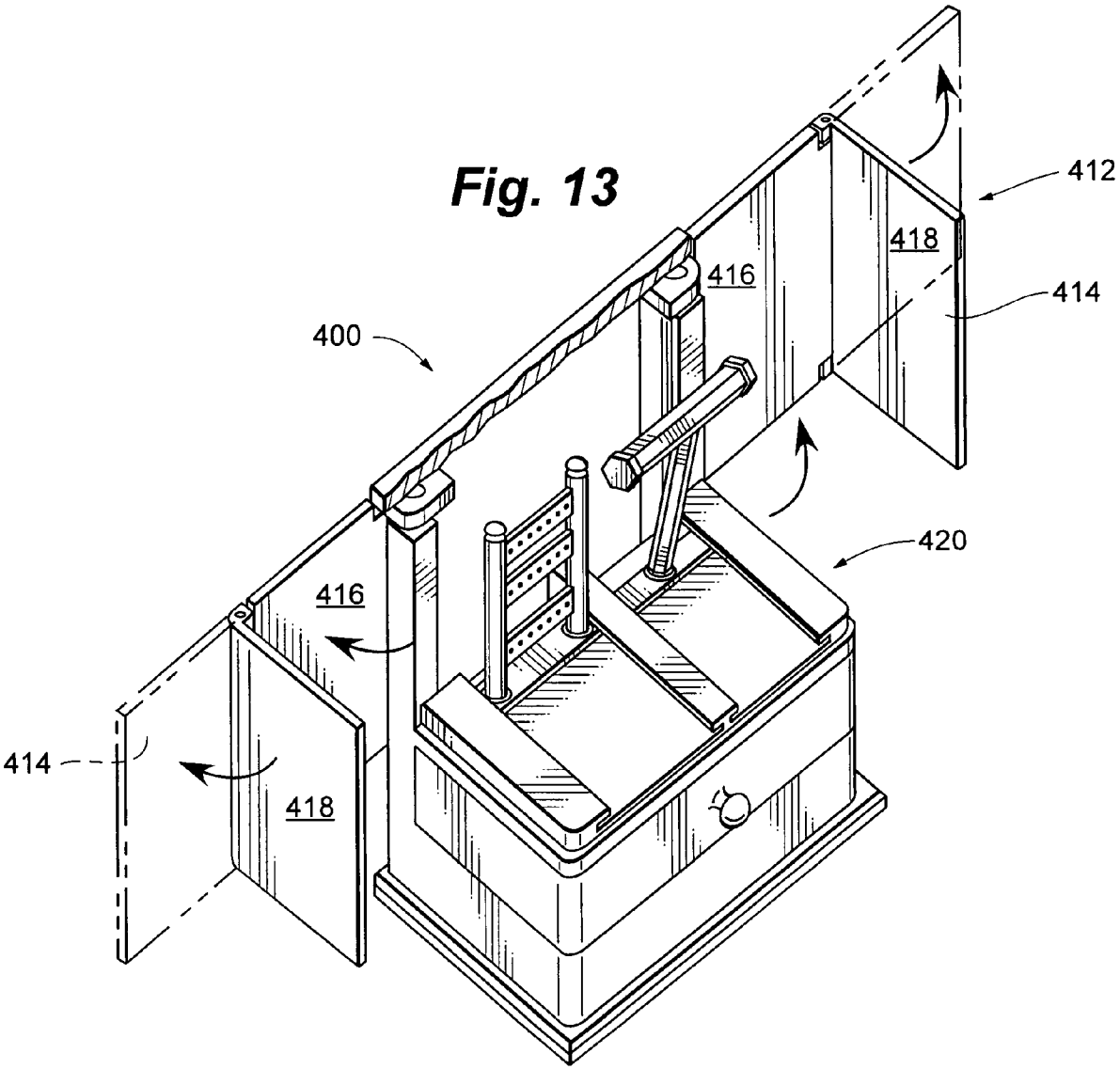
FIG. 13 is a perspective view of an organizer according to another preferred embodiment of the present invention.

FIG. 1 is a front elevational view of an organizer 10 according to a preferred embodiment of the present invention. The organizer 10 which preferably houses jewelry articles, has a top section 12 and a bottom section 14. The top section 12 has a symmetrically arranged pair of doors 16, as will be described in detail hereinafter. The doors 16 can be pivoted from a closed position (as shown) to an open position as will be seen with reference to FIGS. 2 and 3. The bottom section 14 in this preferred embodiment has a symmetrically arranged pair of trays 18 which can be pivoted from a closed position (as shown) to an open position as will be seen with reference to FIG. 2. Below the pair of pivoting trays 18 is a compartment 20 for storing additional jewelry articles and a pedestal 26. In alternate preferred embodiments, the bottom section 14 may have a plurality of pivoting trays stacked one on the other, or the bottom section 14 may have a drawer (as shown in FIG. 13) or a plurality of drawers stacked one above the other. In addition, the bottom section 14 may have solely a compartment 20 which is accessed by pivoting the pair of doors 16 to their open position. Alternately, the bottom section 14 may be just the pedestal 26. The top section 12 of the organizer 10 has a lid 22 that can be pivoted open to expose a mirror (not shown) disposed on an inner surface of the lid 22. Pull handles and/or knobs 24 are included on the doors 16 and trays 18 to allow the user to open the doors and trays.

In a preferred embodiment, the organizer 10 is made of wood or a simulated wood material. Alternatively, it could be made of plastic material or an acrylic. The organizer 10 has an overall height of about 14.75 inches, the top section 12 has a height of about 10.5 inches, the bottom section 14 is about 3 to 4 inches. In particular, the trays 18 have a height of about 1.5 inches, the compartment 20 has a height of about 1.69 inches. The bottom section sits on a base or pedestal 26 that has a height of about 0.5 inches. The lid 22 has a height of about 0.5 inches. Of course, it will be realized that the organizer 10 can have various dimensions and the preferred embodiments of the invention are not limited to the dimensions disclosed.

Figure 2:
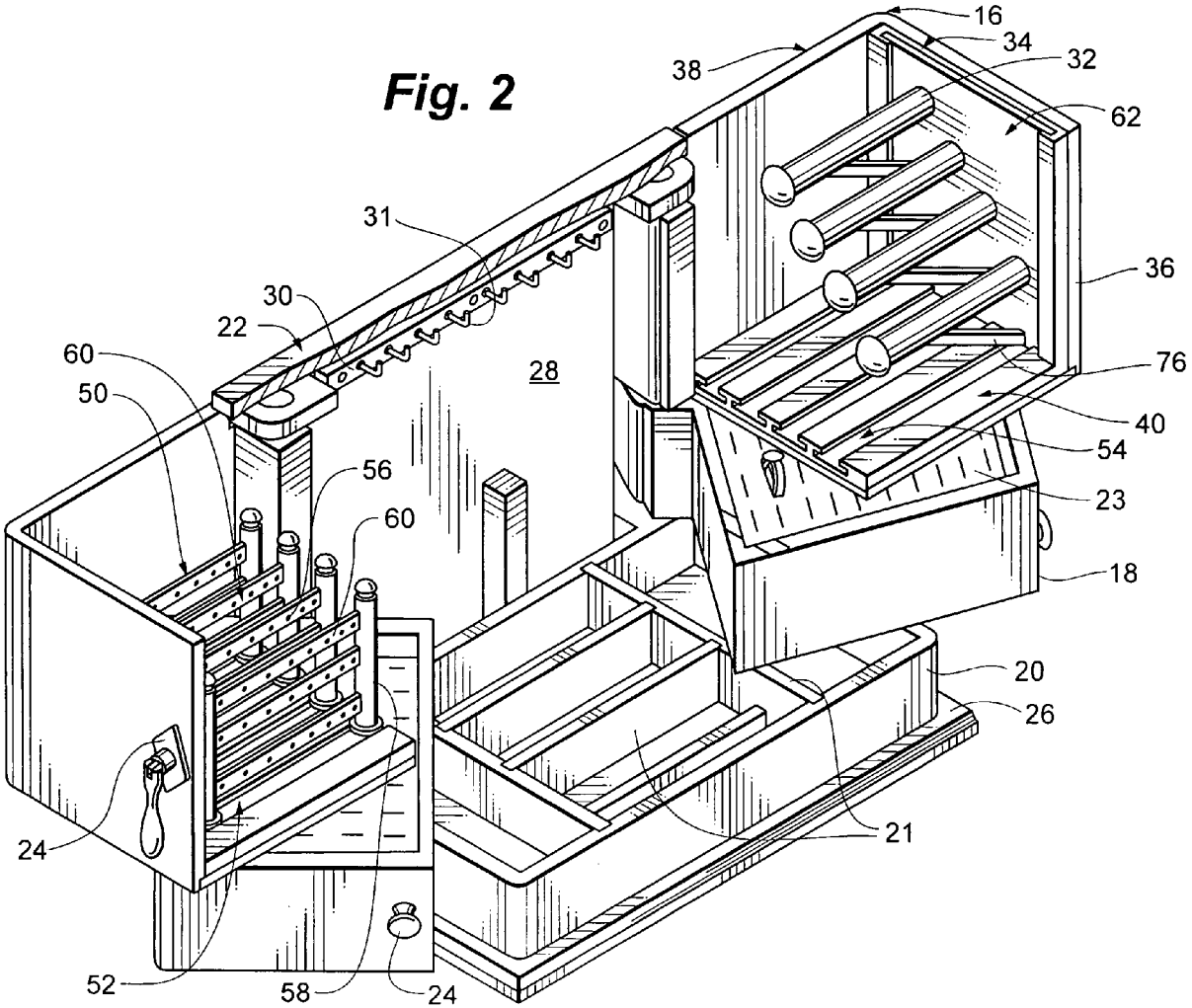
FIG. 2 is a perspective view of the organizer shown in FIG. 1 with the pivoting doors and the pivoting trays partially open.

FIG. 2 is a perspective view of the organizer 10 shown in FIG. 1 with the pivoting doors 16 and the pivoting trays 18 partially open. The organizer 10 has a back wall 28 with a necklace bar 30 secured thereto. The necklace bar 30 has a plurality of hooks 31 on which necklaces may be hung. Inside the pivoting door 16 are a plurality of necklace/bracelet poles 32 affixed to an inner surface 34 of the door 16. In particular, each door 16 has a first wall 38 and a second wall 36 substantially perpendicular to the first wall 38. When the doors 16 are in their closed position, the first wall 38 is substantially perpendicular to the back wall 28 of the organizer 10 and the second wall 36 is substantially parallel thereto. When the doors 16 are in their open position, the first wall 38 of each door 16 is substantially parallel to the back wall 28 and the second wall 36 is substantially perpendicular thereto.

Located underneath the pivoting trays 18 is a compartment 20 in which additional jewelry articles may be stored. Dividers 21 may be located in the compartment 20 to partition the compartment. The dividers 21 may be adjustable and/or removable to allow the user to customize the configuration of the compartment 20. A ring platform 23 is shown located in one of the pivoting trays 18. The ring platform 23 may alternately be located in the compartment 20 and the trays 18 may have adjustable and/or removable dividers.

One of the pivoting doors 16 has a plurality of earring stands 50 located therein. In a preferred embodiment, the earring stands 50 may be slid in and out of the organizer's door. U.S. Pat. No. 5,762,184 entitled "Jewelry Holder with at Least One Movable Stand" by the present inventor, which is incorporated herein by reference, discloses sliding earring stands that are the same as those incorporated into the door 16 of the organizer 10. Each sliding earring stand 50 has a base 52 that is slidably received in a groove or track 54 formed in a floor 40 of the door 16. Each sliding earring stand 50 has a plurality of crosspieces 56 extending between pillars 58. Each crosspiece 56 has a plurality of holes 60 extending there through in which pierced earrings may be secured. In addition, clip earrings may be mounted directly on the crosspiece 56. The base 52 of each earring stand 50 allows it to be self-supporting when removed from the organizer 10.

In a preferred embodiment, the earring stands are about 7.75 inches height. The necklace and bracelet poles are about 6.75 inches long and about 0.75 inches in diameter. Of course the organizer and its various parts may have different dimensions and the preferred embodiments of the invention are not limited to the dimensions disclosed.

The other door 16 preferably houses an accessory plate 62. The accessory plate 62 may be permanently bound to the inner surface 34 of the door 16 or it may be removably mounted to the inner surface 34 of the door 16 as will be described with reference to FIG. 6. If the accessory plate 62 is removably mounted to the inner surface of the door 16, grooves 54 or tracks may be provided on the floor 40 of that door so that if the accessory plate is not mounted to the door, earring stands 50 can be housed therein as well.

Figure 3:
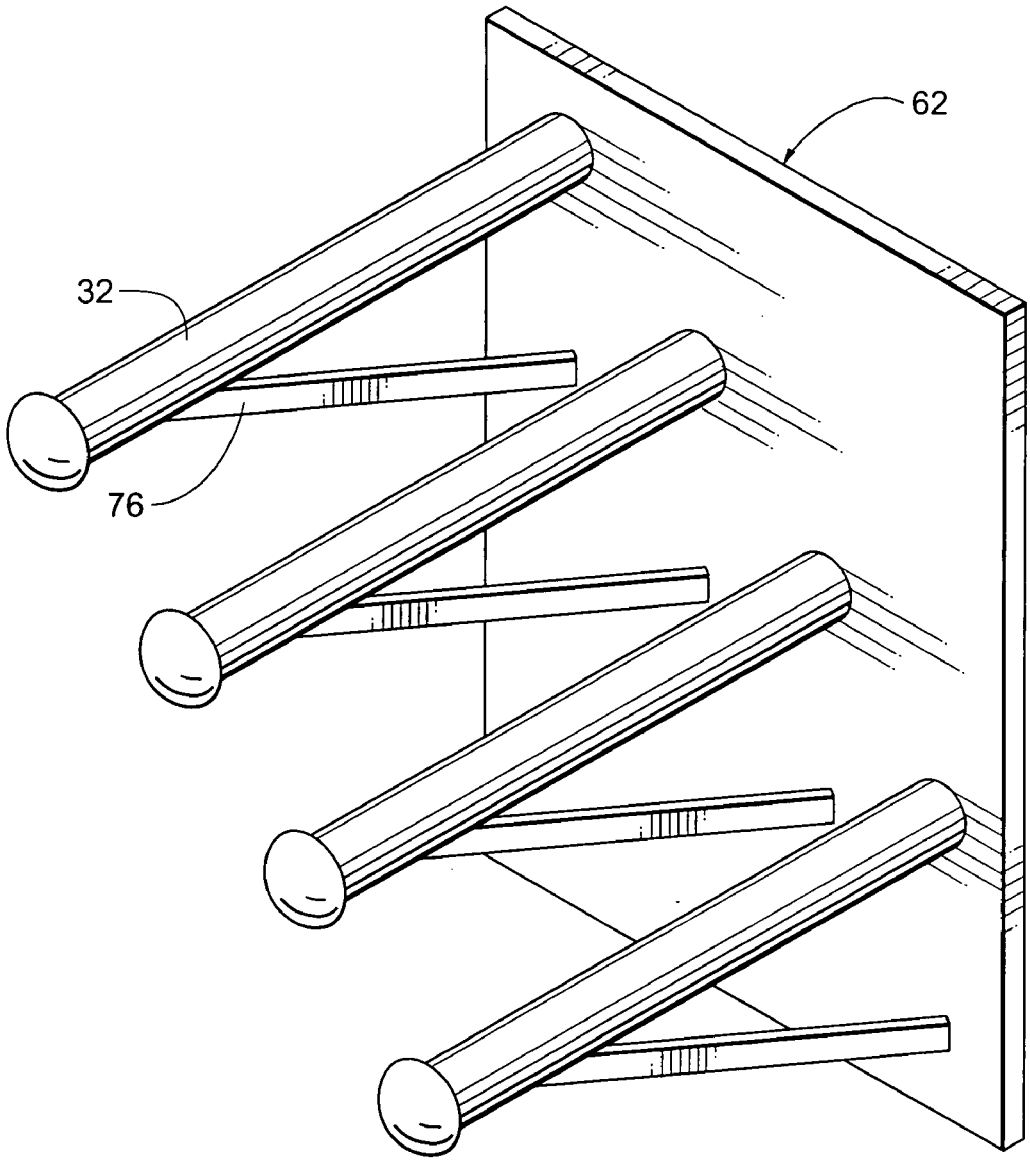
FIG. 3 is a perspective view of an accessory plate according to a preferred embodiment of the present invention.

FIG. 3 is a perspective view of an accessory plate 62 according to a preferred embodiment of the present invention. It can be seen that four necklace/bracelet poles 32 extend from the plate 62. Each pole 32 is located at a particular position on the plate. The poles 32 that are located near the top of the plate 62 are preferably used for necklaces since there is more room underneath the pole 32 for necklaces to hang. The lower bars are preferably for bracelets. The accessory plate 62 may be secured either permanently or removably to the inner surface 34 of the door 16 in various ways. The accessory plate 62 may be glued, riveted, bolted or screwed to the inner surface 34 of the door 16. Alternately, as will be described with reference to FIG. 6, the inner surface 34 of the door 16 may have grooves 70 formed therein which allow the accessory plate 62 to be slid in the grooves into place.

Figure 4:
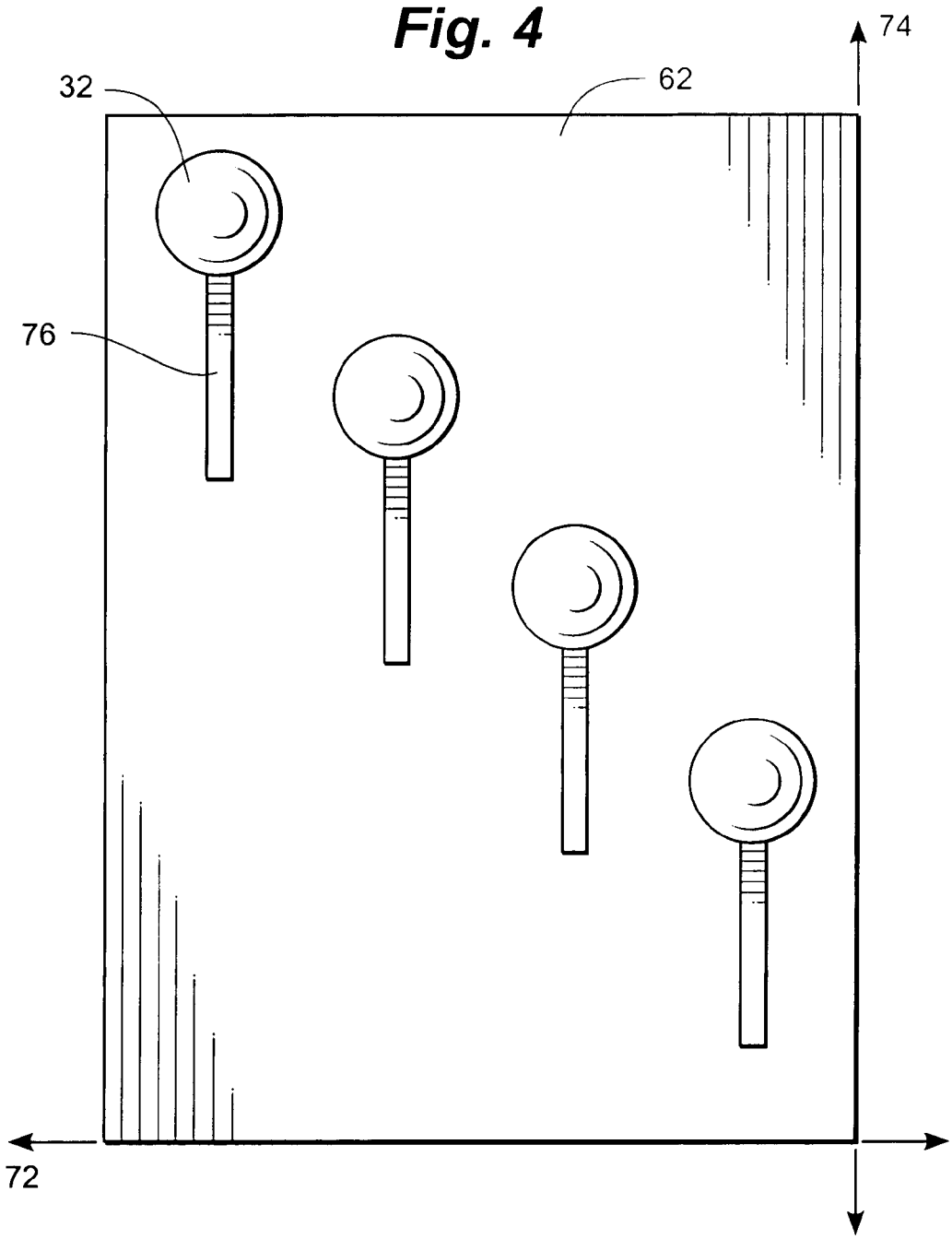
FIG. 4 is a front elevational view of the plate shown in FIG. 3.
Figure 5:
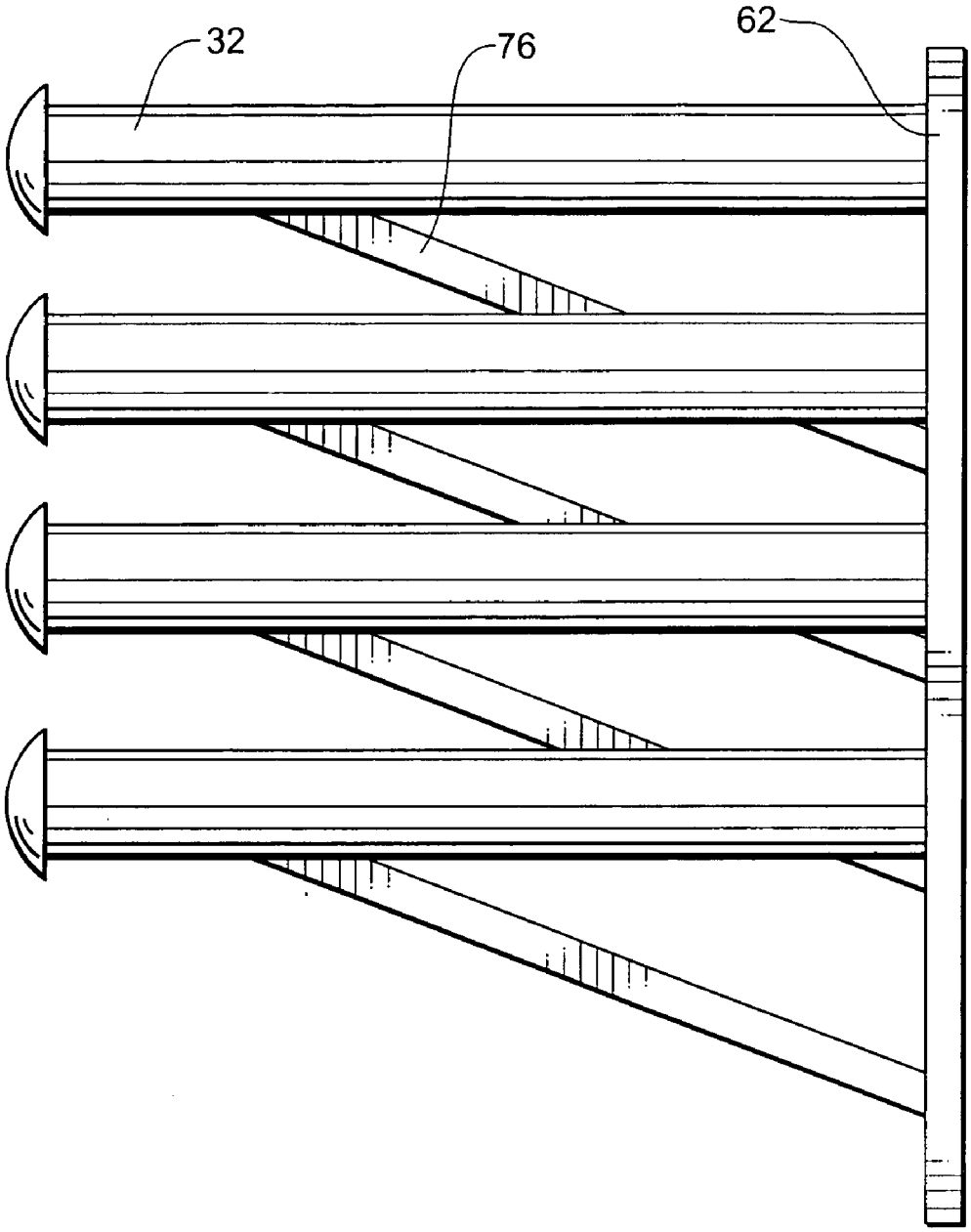
FIG. 5 is a side view of the plate shown in FIG. 3.

FIG. 4 is a front elevational view of the plate 62 shown in FIG. 3. In a preferred embodiment, the poles 32 are separated from one another along a first axis 72 by about 0.75 inches and are separated from each other along a second axis 74 by about 0.5 inches. The accessory plate 62 has a height of about 8 inches and a width of about 5.25 inches. Each pole 32 is supported by a brace 76 that is preferably about 3.25 inches long and 0.375 inches thick. FIG. 5 is a side view of the plate shown in FIG. 3.

Figure 6:
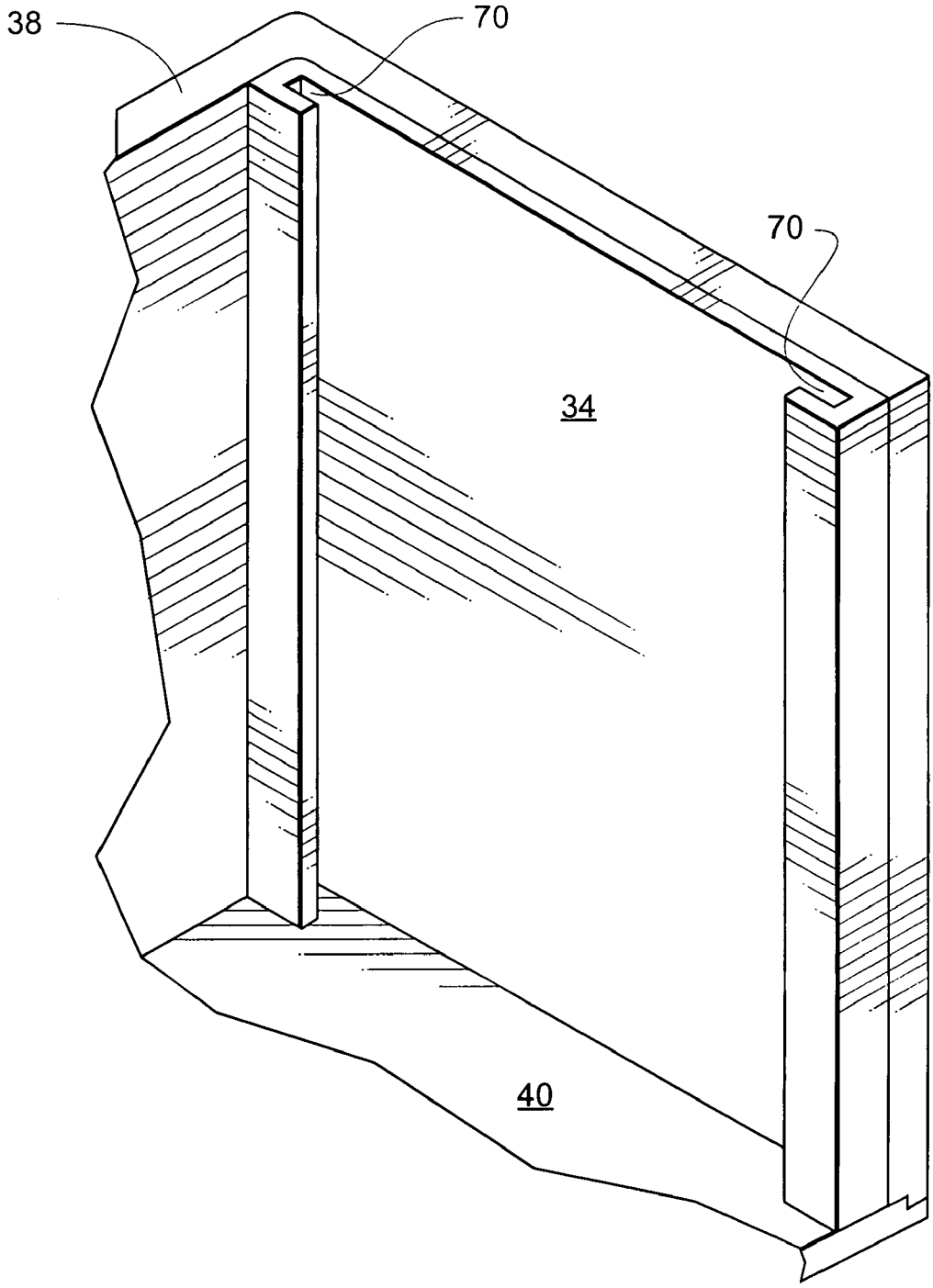
FIG. 6 is an exploded perspective view of a portion of a pivoting door according to another preferred embodiment of the present invention.

FIG. 6 is an exploded perspective view of a portion of a pivoting door 16 according to another preferred embodiment of the present invention. In this preferred embodiment, grooves 70 are provided on the inside of a pivoting door 16. The accessory plate 62 shown in FIGS. 4–6 is slid into the grooves 70. As previously described, in this way, the accessory plate 62 is removable and the user may remove the accessory plate 62 if it is not needed. The floor 40 of the door 16 may be provided with grooves or tracks 54 as shown in FIG. 2 in which additional earring stands 50 may be located if the accessory plate 62 is not used. Thus, the organizer is flexible and can be configured to a user's preferences and needs.

Figure 7:
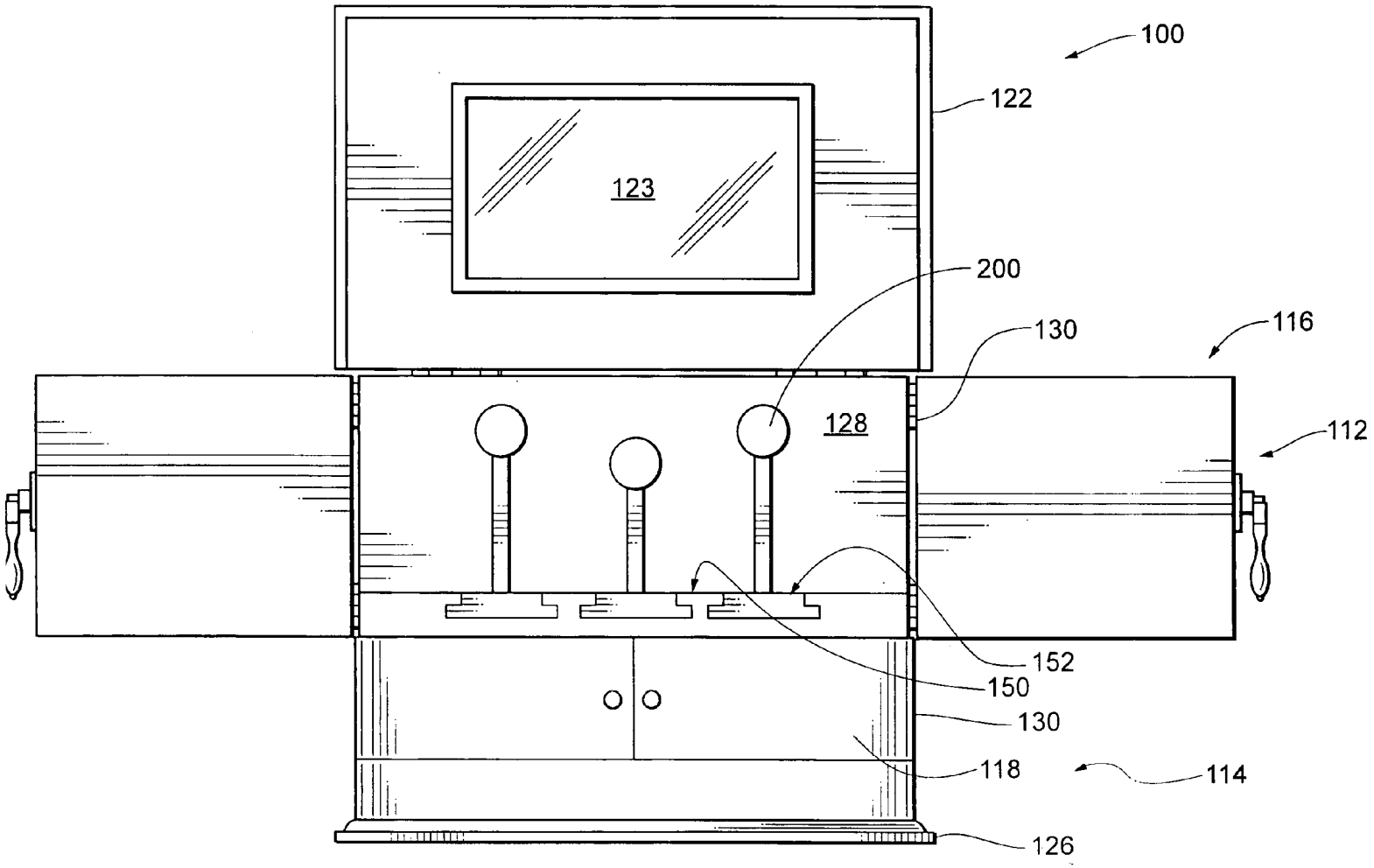
FIG. 7 is a front elevational view of an organizer according to another preferred embodiment of the present invention.

FIG. 7 is a front elevational view of an organizer 100 according to another preferred embodiment of the present invention. In this preferred embodiment, the organizer 100 has a housing with a base 126, back wall (128) extending perpendicularly from the base and side walls 130 also extending perpendicular from the base 126 and back wall 128. The housing has a top section 112 and a bottom section 114. The top section 112 has a pair of doors 116 that enclose a compartment located in the top section. In the compartment, there is a floor 150 that has a plurality of grooves or tracks 152. A plurality of necklace and bracelet stands 200 such as those described in U.S. Pat. No. 6,158,578 by the present inventor and incorporated herein by reference are positioned in the tracks 152. In addition, earring stands like those described with reference to FIG. 2 may also be positioned in the tracks 152 so that the user can customize the compartment to the user's particular needs. The necklace/bracelet stands 200 and/or earring stands (not shown) may be slid out of the container by the user and placed on a surface where the user can select a particular jewelry article. The necklace/bracelet stands 200 and earring stands are free standing so the user can easily view the jewelry articles on the particular stand. The bottom section may be the same as that described with reference to FIG. 1.

Figure 8:
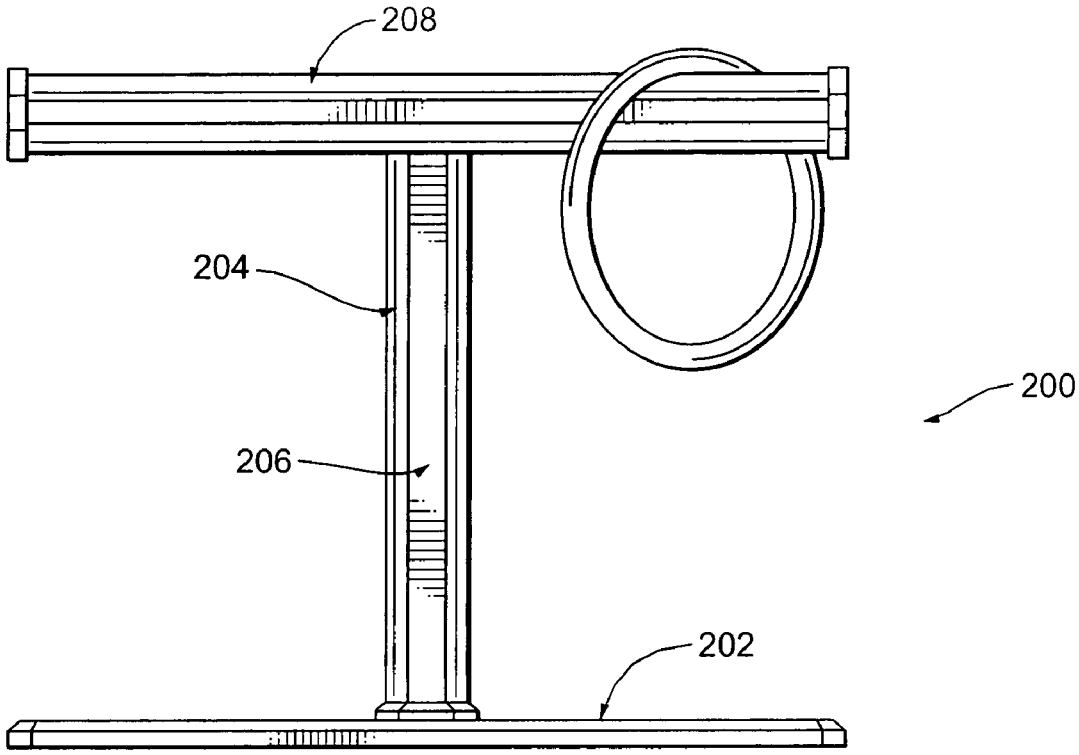
FIG. 8 is a front elevational view of a necklace/bracelet stand shown in FIG. 7.

FIG. 8 is a front elevational view of the necklace/bracelet stand shown in FIG. 7. The necklace/bracelet stand 200 has a bottom member 202 that is slidably received in the track/groove formed in the floor 150. The bottom member 202 allows the necklace/bracelet stand 200 to be self-standing when removed from the organizer 100. The necklace/bracelet stand 200 has a T-shaped member 204 with a central, vertical trunk 206 and a cross bar 208 at the end of the trunk 206. The trunk 206 can have various lengths to accommodate necklaces and bracelets. The cross bar 208 may be cylindrical, as shown, or alternatively, it may have other shapes. In a preferred embodiment, the necklace/bracelet stand 200 is formed as a one piece member.

Figure 9:
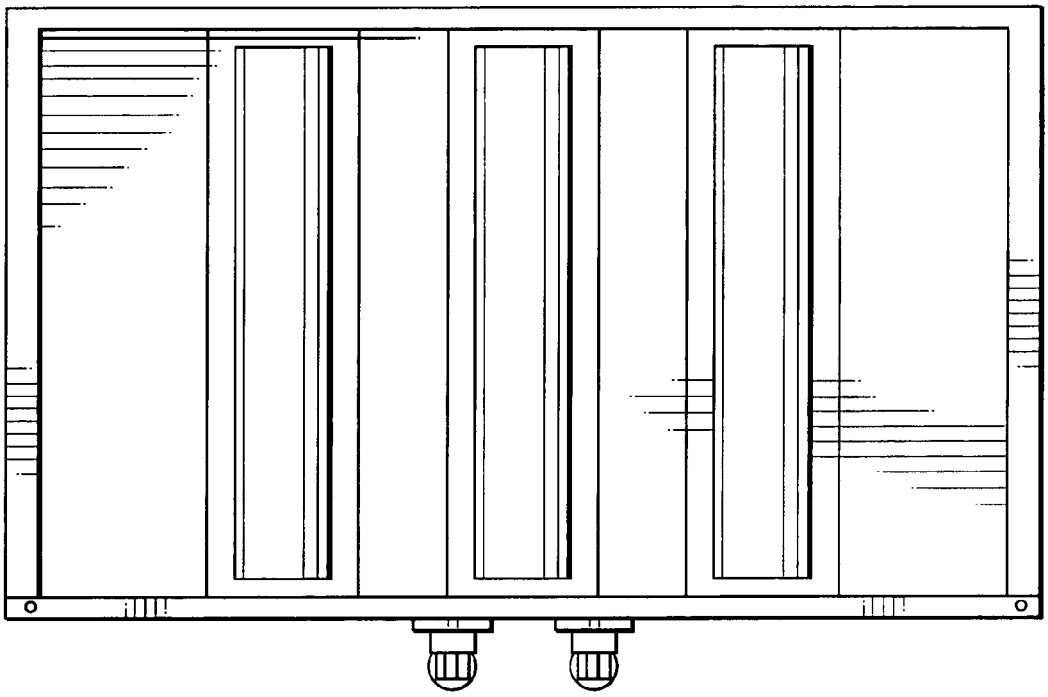
FIG. 9 is a top view of the organizer shown in FIG. 7.

FIG. 9 is a top view of the organizer shown in FIG. 7 with its lid removed and with the doors closed.

Figure 10:
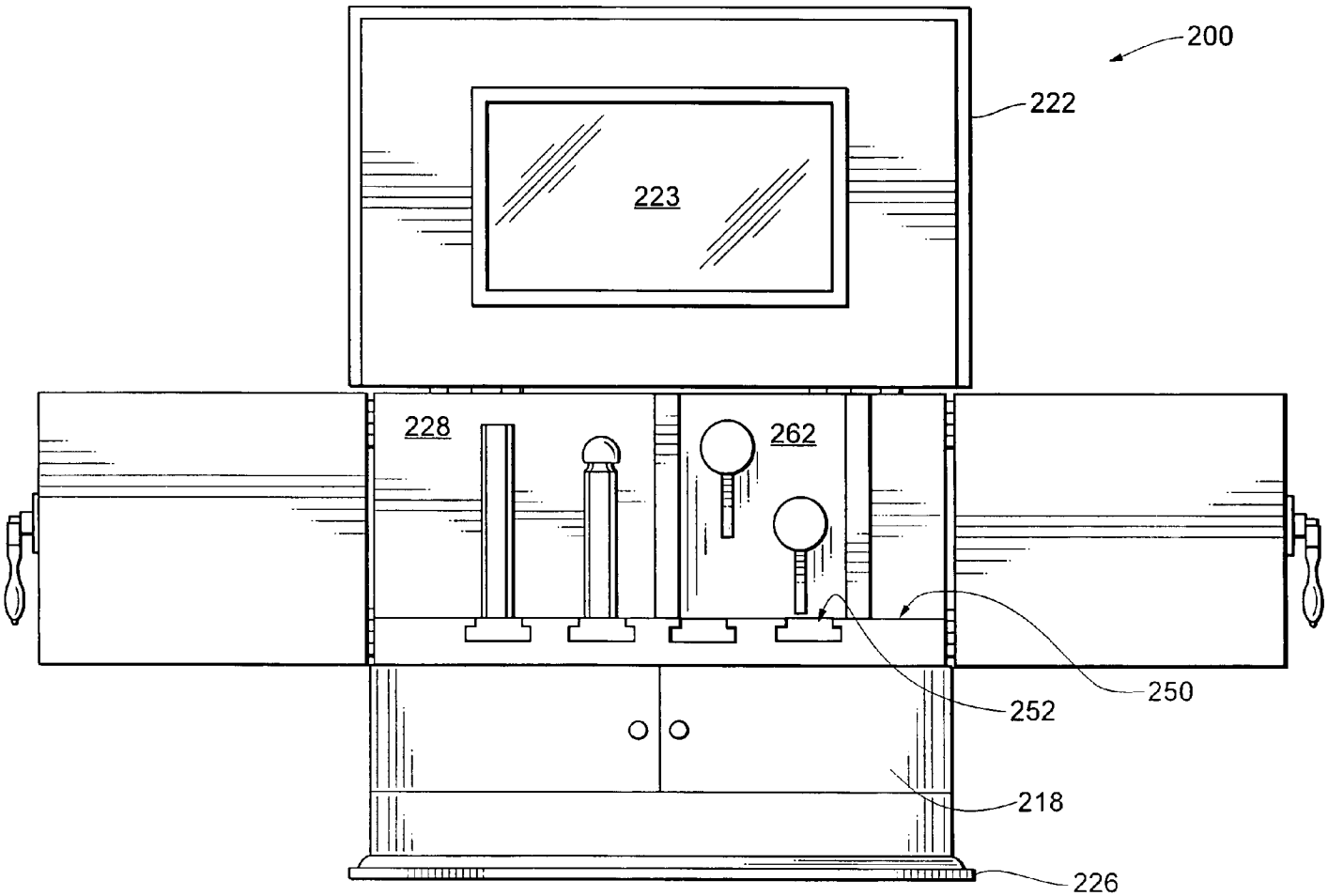
FIG. 10 is a front elevational view of an organizer according to another embodiment of the present invention.
Figure 11:
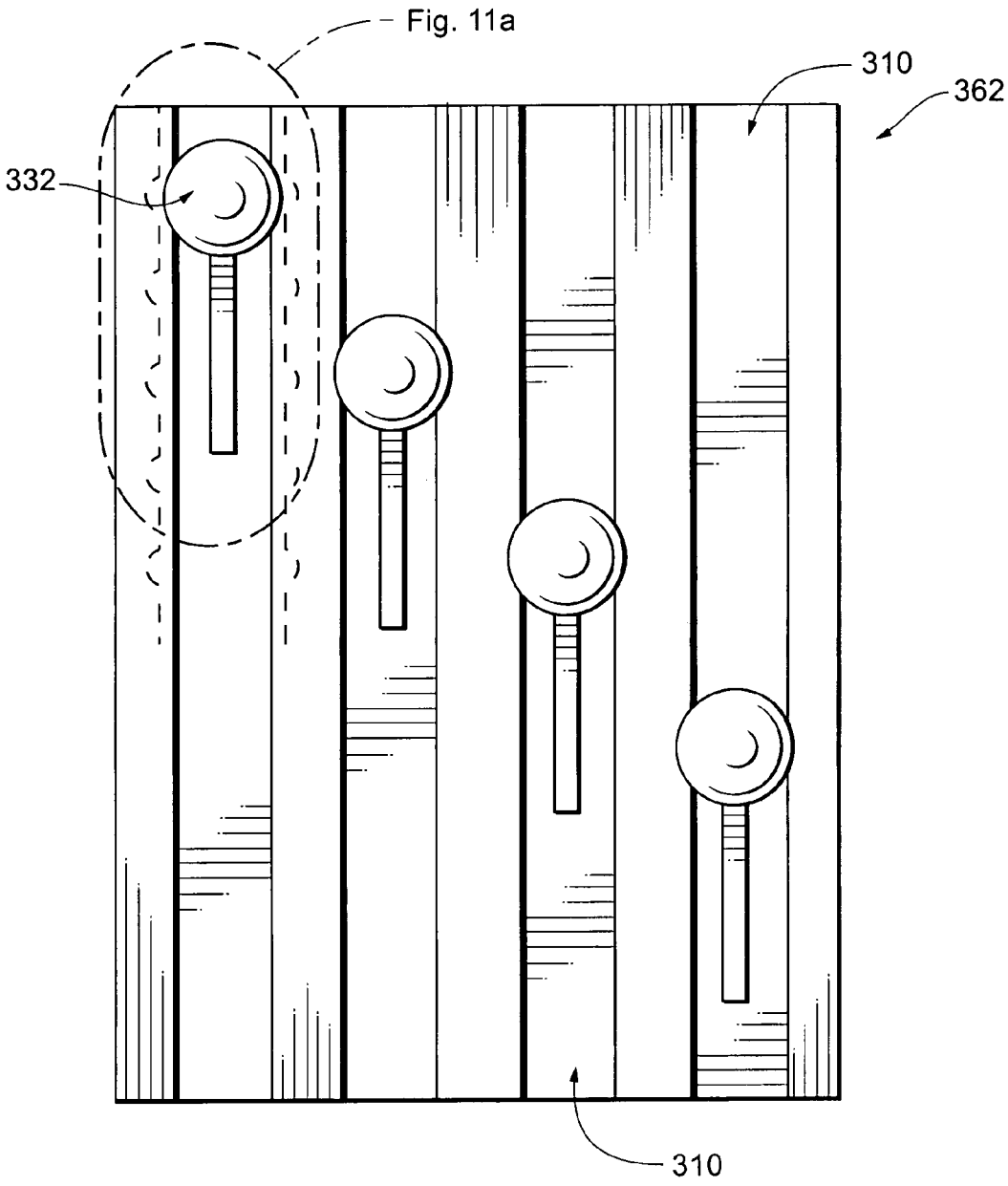
FIG. 11 is a front elevational view of an accessory plate according to another preferred embodiment of the present invention.

FIG. 10 is a front elevational view of an organizer 200 according to another embodiment of the present invention. The organizer has a compartment like that shown in FIG. 7. The floor 250 of the compartment may be provided with groove/tracks 252 in which earring stands and necklace/bracelet stands may be received. In addition, the back wall 220 may have grooves such as those shown in FIG. 7 to accommodate an accessory plate 262 such as that shown in FIG. 4. In addition, additional grooves may be provided in the back wall 228 so that various sizes of accessory plates may be received. As shown in FIG. 11, the accessory plate 262 occupies about half of the back wall 128.

Figure 11A:
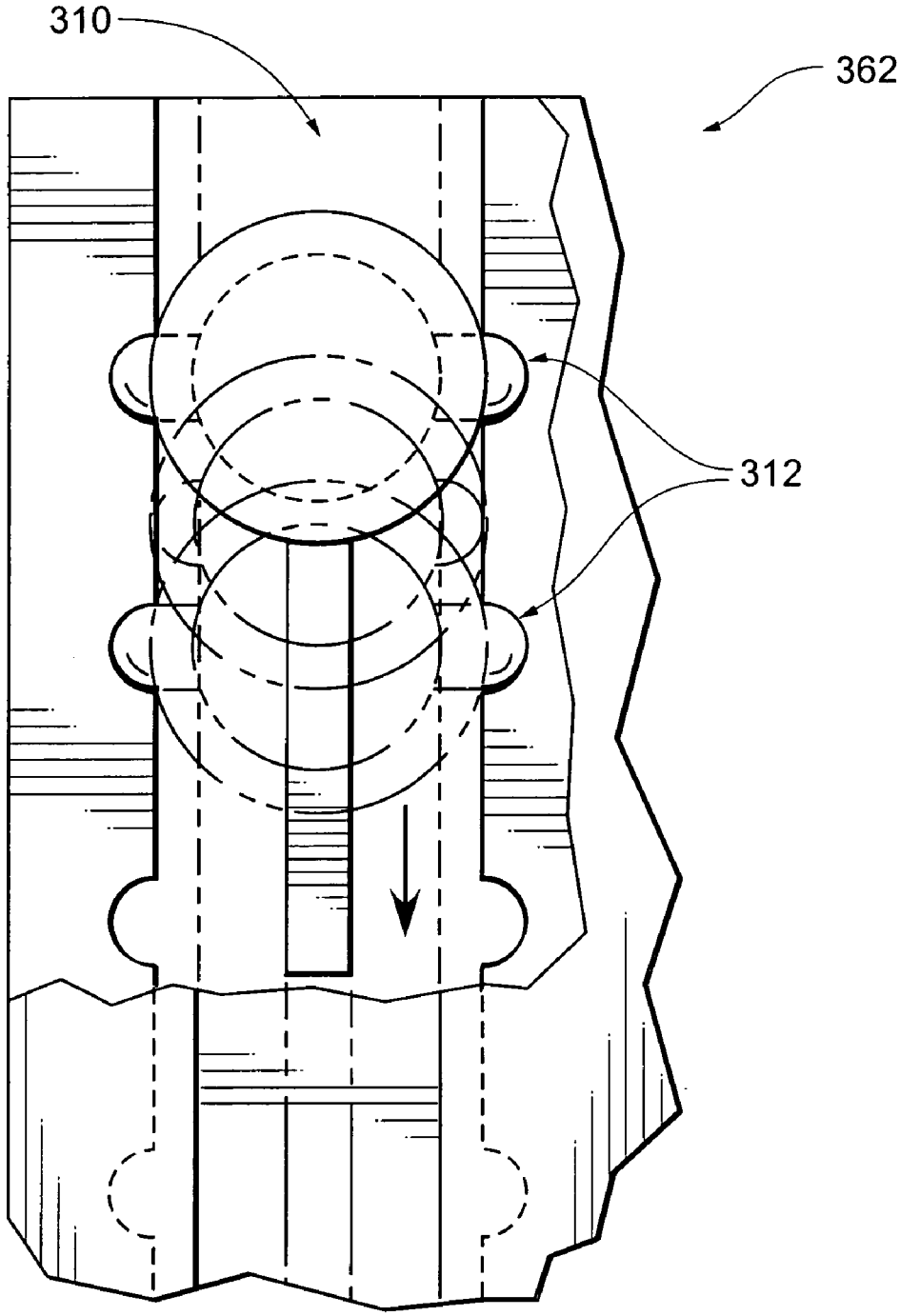
FIG. 11*a* is an enlarged view of a portion of the accessory plate shown in FIG. 11.

FIG. 11 is a front elevational view of an accessory plate 362 according to another preferred embodiment of the present invention. In this preferred embodiment, the necklace/bracelet poles 332 are positionable. In particular, the accessory plate 362 has a groove or track 310 for each pole 332. As shown in detail in FIG. 11*a*, each track/groove 310 has a plurality of alcoves 312 along its length. Each pole 332 has a pair of detent mechanisms on its side that are spring loaded to extend into an alcove 312 when released. More particularly, as shown in FIG. 12*a*, a user would press the detent mechanism located on each side of the pole 332 to disengage the detent mechanism from a particular alcove. The user would then slide the pole 332 to the desired location where there is an alcove 312, release the detent mechanism so that it engages that particular alcove to hold the necklace/bracelet pole at that position. The brace of the pole slides with the pole. Alternatively, the brace may be eliminated from supporting the pole.

Figure 12:
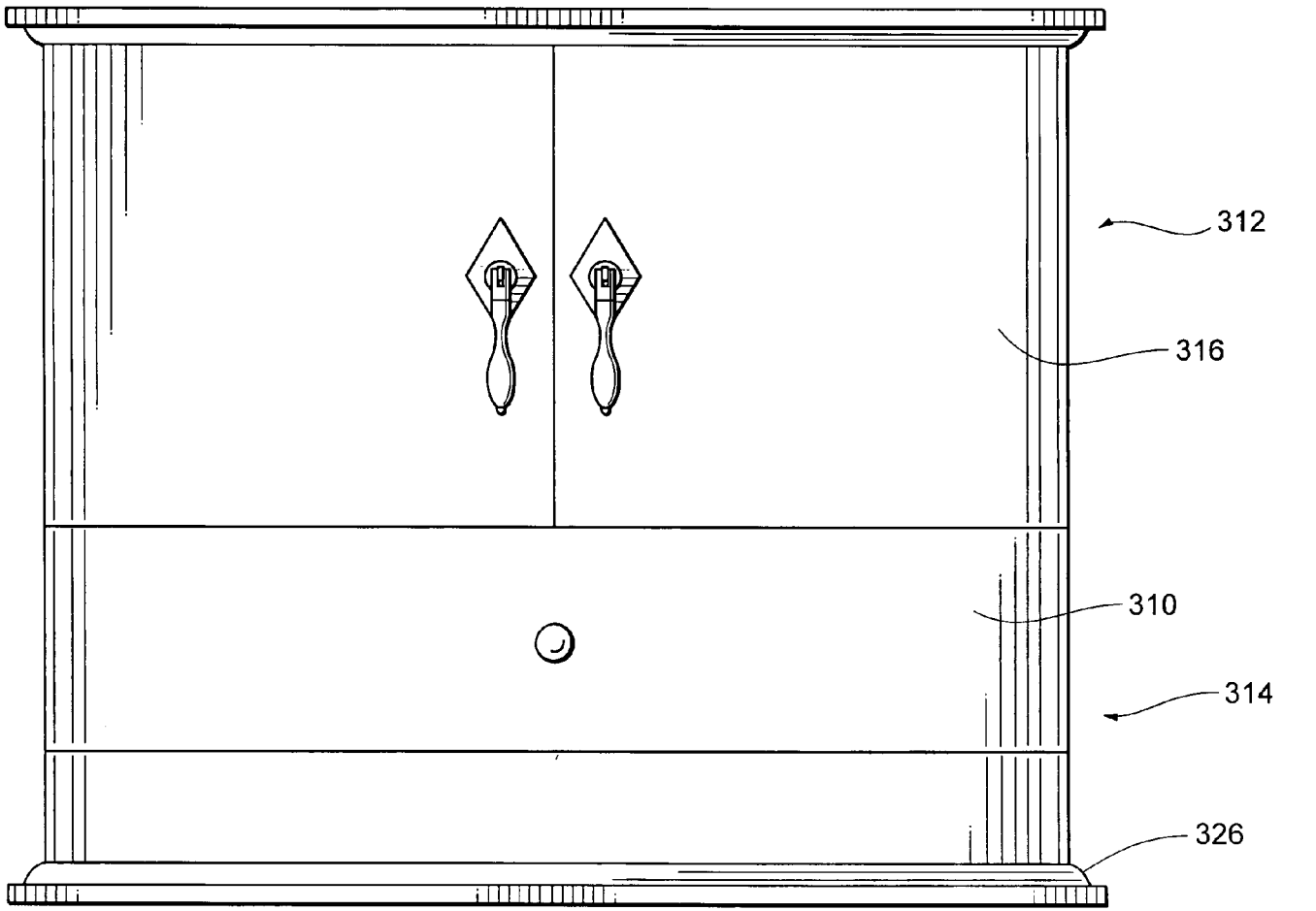
FIG. 12 is a front elevational view of an organizer according to another preferred embodiment of the present invention having a drawer.

FIG. 12 is a front elevational view of an organizer 300 according to another preferred embodiment of the present invention. In this preferred embodiment the organizer 300 has a drawer 310 instead of a pair of pivoting trays as shown in FIG. 1. In this preferred embodiment, the top section 312 may have any of the embodiments previously disclosed. The bottom section 314 includes at least one drawer 310. Alternatively, the bottom section 314 may include a plurality of drawers and/or pivoting trays and the present invention is not limited to the particular embodiments illustrated. In addition, the bottom section 314 may be a compartment that is accessible when the doors 16 are open or it may be a base 20 without drawers or pivoting trays. Dividers such as those described with reference to FIG. 2 may be located in the drawer 310 to partition the compartment in the drawer 310. The dividers may be adjustable and/or removable to allow the user to customize the configuration of the drawer 310.

The pivoting trays, drawer and storage compartment may have removable dividers to allow a user to customize the configuration of the tray, drawer or storage compartment. Also, stand alone storage compartments can be dropped into the tray, drawer or storage compartment according to the user's needs. In addition, a ring platform may be provided in the tray, drawer or storage compartment.

FIG. 13 is a perspective view of an organizer 400 according to another preferred embodiment of the present invention. In this preferred embodiment the top section 412 of the organizer 400 has a pair of doors 414 that are each formed of two parts, a first part 418 that folders over a side of the organizer and a second part 416 that is pivotally coupled to the first part 418 and folds over the front of the organizer. Located in the top section 412 is a compartment 420 in which a plurality of grooves are formed on a floor of the compartment. The grooves are dimensioned to receive a slidable earring stand and/or necklace/bracelet stand that can be slid in from the sides of the organizer.

Some or all of the interior surfaces of the jewelry organizer may be covered with an anti-tarnish cloth.

In an alternate embodiment, the accessory poles 32 may be mounted directly to the inner surface 34 of the door 16 or directly to the back wall 228 of the armoire. For such direct mounting, the accessory poles may be glued in place, screwed in place, nailed in place or secured by any other known mounting method.

While the armoire is shown as shaped as a box, it will be appreciated that it may have other shapes such as circular or oval or other curved surfaces.

The above specification provides a complete description of the manufacture and use of the invention. Since many embodiments of the invention can be made without departing from the spirit and scope of the invention, the invention resides in the claims hereinafter appended.

What is claimed is:

1. An organizer comprising:

a framework having a base and a back wall extending perpendicularly from the base;

a pair of symmetrically arranged doors pivotally coupled to the back wall wherein each door has a first wall and a second wall perpendicular to the first wall, wherein the doors can be pivoted from a first closed position to a second open position, wherein in the closed position, the first walls are substantially parallel with the back wall and each second wall extends between the back wall and a respective first wall so that the organizer has a box shape and wherein in the second open position, the second walls are substantially parallel with the back wall;

at least one pole including a first end affixed to an interior side of the first wall of one of the pair of doors and a second, free end, the at least one pole extending from the interior side of the first wall to the second, free end; and wherein the interior side of the first wall of the one of the pair of doors is formed by a plate removably mounted to the first wall.

2. The organizer according to claim 1 wherein the at least one pole comprises a plurality of poles.

3. The organizer according to claim 2 wherein each of the plurality of poles is located at a select height along an interior side of the first wall.

4. The organizer of claim 2, wherein none of the plurality of poles are horizontally aligned with another one.

5. The organizer of claim 4, wherein none of the plurality of poles are vertically aligned with one another.

6. The organizer according to claim 1 further comprising a necklace bar comprising a plurality of hooks affixed to the back wall of the organizer.

7. The organizer according to claim 1 further comprising a storage compartment located underneath the pair of doors.

8. The organizer according to claim 7 wherein the storage compartment includes dividers to partition the compartment.

9. The organizer according to claim 8 wherein the dividers are removable.

10. The organizer according to claim 8 wherein the dividers are adjustable to customize the interior of the storage compartment.

11. The organizer according to claim 1 further comprising a pair of symmetrically arranged pivoting trays that can be pivoted from a first closed position to a second open position, wherein the trays are located underneath the pair of doors and when the trays are in the first closed position, the organizer has a box shape.

12. The organizer according to claim 11 further comprising a ring holder located in a one of the pair of trays.

13. The organizer according to claim 1 wherein at least some portions of internal surfaces of the organizer are lined with anti-tarnish cloth.

14. The organizer according to claim 1 further comprising a pivoting lid located above the pair of doors.

15. The organizer according to claim 14 further comprising a mirror disposed on an inner surface of the lid.

16. The organizer according to claim 1 wherein the pole extends substantially perpendicularly to the first wall.

17. The organizer of claim 1, wherein the at least one pole extends over a length approximately spanning a depth of the second wall of the one of the pair of doors, the depth defined from an intersection of the first wall of the one of the pair of doors with the second wall of the one of the pair of doors to the pivotal coupling of the one of the pair of doors with the back wall.

18. An organizer comprising:

a framework having a base and a back wall extending perpendicularly from the base;

a pair of symmetrically arranged doors pivotally coupled to the back wall wherein each door has a first wall and a second wall perpendicular to the first wall, wherein the doors can be pivoted from a first closed position to a second open position, wherein in the closed position, the first walls are substantially parallel with the back wall and each second wall extends between the back wall and a respective first wall so that the organizer has a box shape and wherein in the second open position, the second walls are substantially parallel with the back wall;

at least one pole including a first end affixed to an interior side of the first wall of one of the pair of doors and a second, free end, the at least one pole extending from the interior side of the first wall to the second, free end; and wherein another of the pair of doors has a floor extending between the first and second walls and further comprising a groove formed in the floor and a separate first stand having a base which is dimensioned to be slidably received in the groove formed in the floor, the stand has a pair of vertical supports extending upwardly from its base and a cross piece extending between the pair off vertical supports.

19. An organizer comprising:

a framework having a base and a back wall extending perpendicularly from the base;

a pair of symmetrically arranged doors pivotally coupled to the back wall wherein each door has a first wall and a second wall perpendicular to the first wall, wherein the doors can be pivoted from a first closed position to a second open position, wherein in the closed position, the first walls are substantially parallel with the back wall and each second wall extends between the back wall and a respective first wall so that the organizer has a box shape and wherein in the second open position, the second walls are substantially parallel with the back wall;

at least one pole including a first end affixed to an interior side of the first wall of one of the pair of doors and a second, free end, the at least one pole extending from the interior side of the first wall to the second, free end; and wherein the interior side of the first wall of the one of the pair of doors is formed by an accessory plate that can be slid into place along the first wall.

20. An organizer comprising:

a framework having a base and a back wall extending from the base;

a pair of symmetrically arranged doors pivotally coupled to the back wall, wherein the doors can be pivoted from a first closed position to a second open position;

a pivoting lid located above the pair of doors; and at least one pole extending from an interior side of one of the pair of doors;

wherein another of the pair of doors has a floor and a groove formed in the floor and a separate first stand having a base which is dimensioned to be slidably received in the groove formed in the floor, the stand has a pair of vertical supports extending upwardly from its base and a cross piece extending between the pair off vertical supports.

21. The organizer according to claim 20 wherein the at least one pole comprises a plurality of poles.

22. The organizer according to claim 21 wherein each of the plurality of poles is located at a select height.

23. The organizer according to claim 20 further comprising a necklace bar comprising a plurality of hooks affixed to the back wall of the organizer.

24. The organizer according to claim 20 further comprising a storage compartment located underneath the pair of doors.

25. The organizer according to claim 24 wherein the storage compartment includes dividers to partition the compartment.

26. The organizer according to claim 25 wherein the dividers are removable.

27. The organizer according to claim 25 wherein the dividers are adjustable to customize the interior of the storage compartment.

28. The organizer according to claim 20 further comprising a pair of symmetrically arranged pivoting trays that can be pivoted from a first closed position to a second open position.

29. The organizer according to claim 28 further comprising a ring holder located in a one of the pair of trays.

30. The organizer according to claim 20 wherein at least some portions of internal surfaces of the organizer are lined with anti-tarnish cloth.

31. The organizer according to claim 20 further comprising a mirror disposed on an inner surface of the lid.

32. The organizer of claim 20, wherein the at least one pole is attached to a plate removably mounted to the interior side of the at least one door.

* * * * *